United States Patent [19]

John et al.

[11] Patent Number: 5,009,158

[45] Date of Patent: Apr. 23, 1991

[54] OFFSET PRINTING MACHINE SYSTEM

[75] Inventors: Thomas John; Georg Bock, both of Augsburg, Fed. Rep. of Germany

[73] Assignee: MAN Roland Druckmaschinen AG, Offenbach am Main, Fed. Rep. of Germany

[21] Appl. No.: 542,879

[22] Filed: Jun. 25, 1990

[30] Foreign Application Priority Data

Jul. 8, 1989 [DE] Fed. Rep. of Germany ..... 3922559

[51] Int. Cl.[5] ..... B41F 5/04

[52] U.S. Cl. ..... 101/219; 101/248

[58] Field of Search ..... 101/219, 216, 142, 248, 101/347, 348, 349, 350, 141, 329, 493

[56] References Cited

U.S. PATENT DOCUMENTS

| | | | |
|---|---|---|---|
| 2,036,835 | 4/1936 | Sites . | |
| 2,136,683 | 11/1938 | Gochoel | 101/219 |
| 2,301,379 | 11/1942 | Davis . | |
| 2,573,090 | 10/1951 | Beasley | 101/216 |
| 3,026,798 | 3/1962 | Frostad | 101/248 |
| 3,139,826 | 7/1964 | Rainwater | 101/493 |
| 3,163,109 | 12/1964 | Stelling, Jr. | 101/219 |
| 3,191,531 | 6/1965 | Worthington et al. | 101/219 |
| 3,585,932 | 6/1971 | Granger | 101/350 |
| 3,590,735 | 7/1971 | Treff | 101/350 |
| 3,633,504 | 9/1972 | Chambon | 101/219 |
| 3,724,047 | 4/1973 | Peterson | 101/348 |
| 3,774,537 | 11/1973 | Christoff | 101/219 |
| 3,910,186 | 10/1975 | D'Amoto et al. | 101/350 |
| 3,930,446 | 1/1976 | Nulton | 101/493 |
| 4,000,242 | 12/1976 | Hartbauer | 101/216 |
| 4,072,104 | 2/1978 | Schaffer | 101/248 |
| 4,223,603 | 9/1980 | Faddis et al. | 101/350 |
| 4,445,433 | 5/1984 | Navl | 101/350 |
| 4,573,407 | 3/1986 | Jeschke | 101/349 |
| 4,637,310 | 1/1987 | Sato et al. | 101/493 |

FOREIGN PATENT DOCUMENTS

| | | |
|---|---|---|
| 625327 | 2/1936 | Fed. Rep. of Germany . |
| 3117341 | 11/1982 | Fed. Rep. of Germany . |

*Primary Examiner*—Eugene H. Eickholt

*Attorney, Agent, or Firm*—Frishauf, Holtz, Goodman & Woodward

[57] ABSTRACT

To permit use of a yielding surface covering (19, 48) on an ink application cylinder (7, 32) in an offset printing machine, without slippage or rubbing between the ink application cylinder and an adjacent plate cylinder (5, 31), a drive is arranged between the plate cylinder and the ink application cylinder which provides for corresponding linear circumferential speed by, either, placing an auxiliary idler gear train (17, 18) between the plate cylinder gear (15) and the drive gear (16) for the ink application cylinder, or independently driving the ink application cylinder (7) by an electric motor.

13 Claims, 2 Drawing Sheets

OFFSET PRINTING MACHINE SYSTEM

FIELD OF THE INVENTION

The present invention relates to rotary offset printing machines, and more particularly to such printing machines which have an ink application cylinder engageable with the plate cylinder, in which the ink application cylinder has a working surface which is resilient and yielding, and wherein the ink application cylinder is driven at the same speed as the drive speed of the plate cylinder, so that the plate cylinder and the ink application cylinder roll off against each other.

BACKGROUND

German Patent No. 31 17 341 describes an arrangement in which an ink application cylinder has effectively the same diameter as the plate cylinder. The plate cylinder may carry one or more printing plates thereon. The ink application cylinder, the diameter of which corresponds to the effective working diameter of the plate cylinder with the printing plates is driven to have the same circumferential speed as the plate cylinder and, in the engagement zone between plate cylinder and ink application roller, it rotates in the same direction. The ink application cylinder has a yielding surface.

The yielding surface of the ink application cylinder causes slippage and rubbing between the ink application cylinder and the plate cylinder, due to the compression of the yielding surface of the ink application cylinder as the consequence of engagement pressure between the two cylinders. This slippage and rubbing causes excessive wear on the printing plates, heats the cylinders, and also causes problems in connection with supply of damping fluid, typically water. The heating leads to expansion of the volume of the working surface of the ink application cylinder, which then changes the engagement relationships between the engaged cylinders, further increasing the rubbing effect. More damping fluid is emulsified in the ink due to the slippage and rubbing than would be the case if there were no slippage. This damping fluid then is no longer available for application to the surface of the printing plate in the region where printing is not to be effected. The result is scumming or tinting of the printing substrate. Increased supply of damping fluid counteracts such scumming. The ability of most inks to emulsify damping fluid has a limit, however, and thus, if too much damping fluid is applied, damping or water marks may occur on the substrate. Additionally, the viscosity or flowability of many inks is undesirably affected if the proportion of water emulsified therein is too high.

U.S. Pat. No. 2,036,835, to which German Patent No. 625,327 corresponds, disclose that slippage or rubbing occurs between the plate cylinder and the blanket cylinder of an offset printing machine if both cylinders have exactly the same working diameters. To avoid such slippage, it has been proposed to slightly increase the diameter of the plate cylinder and decrease the diameter of the blanket cylinder. When using incompressible blankets, this opposite relationship then avoids slippage and rubbing. Rubber blankets which are incompressible deform, however, so that, upon compression of the rubber blanket by the plate cylinder, a bulge will be formed.

It has been found that changing the diameters of the plate and rubber blanket cylinder is not a suitable solution when using compressive or compressible blankets on the blanket cylinder. Compressible blankets decrease the volume due to compression by the plate cylinder. The change in the diameters of the respective cylinders does not remove the rubbing or slippage between the cylinders.

Using excess damping fluid, regardless of the diametrical relationship of the blanket cylinder and the plate cylinder, raises special problems when inkers are used which include an anilox cylinder to supply ink. Returned or fed-back ink-damping fluid emulsions hardly evaporate from an anilox cylinder. There is, therefore, only a very narrow range in which just sufficient, but not excessive damping fluid can be supplied. Adjusting the quantity of supply of damping fluid within this narrow range is difficult and expensive. It has been found, further, that the proportion of damping fluid emulsified within the ink increases as the slippage or rubbing increases.

Changing the relative diameters of the plate cylinder and an ink application cylinder in opposite directions is often not possible since the working diameter of the plate cylinder is determined with reference to the blanket cylinder. Driving the ink application cylinder with a speed which differs from that of the plate cylinder is likewise not possible since, otherwise, striping or ghost patterning may occur. Thus, any changes in diameter to provide for a relative difference between plate cylinder diameter and ink application roller diameter must be accepted by the ink application roller. Consequently, the spacing of the shaft centers of the plate cylinder to the ink application cylinder will change. The shafts, however, carry gears of equal size in order to obtain the appropriate 1:1 transmission ratio. It is thus possible to compensate for changes in axial spacing by shifting the gear profiles only within very small dimensions.

The discussion in the aformentioned U.S. Pat. No. 2,036,835 with respect to relative diametric relationships of the blanket cylinder and the plate cylinder is restricted specifically to these two cylinders, and what could happen if the ink application roller or cylinder has a compressible surface is not disclosed.

THE INVENTION

It is an object to provide a printing system in which slippage or rubbing between the plate cylinder and an ink application cylinder is effectively eliminated, even if the spacing of the shaft diameters between the plate cylinder and the ink application cyliner must be changed to a far greater extent than possible by mere changing the profile or gear tip dimensions of engaged gears.

Briefly, the radius of the ink application cylinder, upon engagement with and compression by the plate cylinder, will differ from the radius of the plate cylinder by an extent which requires shaft positions of the cylinders in the machine frame such that the centers of the shafts are spaced differently than the diameter of the plate cylinder to compensate for compression of a yielding surface of the ink application cylinder at an engagement region between these cylinders. The two cylinders are driven at the same speed; in accordance with a feature of the invention, the ink application cylinder is driven not directly from a gear coupled to the plate cylinder but, rather, through two auxiliary gears located laterally with respect to the position of the drive gear for the plate cylinder so that the bearing or shaft position for the ink application cylinder can be placed at a suitable distance from the bearing or shaft position of the plate cylinder. Alternatively, the ink application cylinder can be driven independently, for example by an electric motor.

The arrangement has the advantage that rubbing or slippage is effectively eliminated, the cylinders can readily be placed in the printing machine as desired without complex modification of gears, and application of ink from, for example, an anilox roller with a short-train inker is entirely feasible. Further, the shaft of the ink application roller, which need be extended only slightly, can be used as a bearing shaft to transmit torque to the anilox roller, since the speed relationship between the anilox roller and the ink application, or the plate cylinder, can be other than 1:1.

DRAWINGS

DETAILED DESCRIPTION

Figure 2:
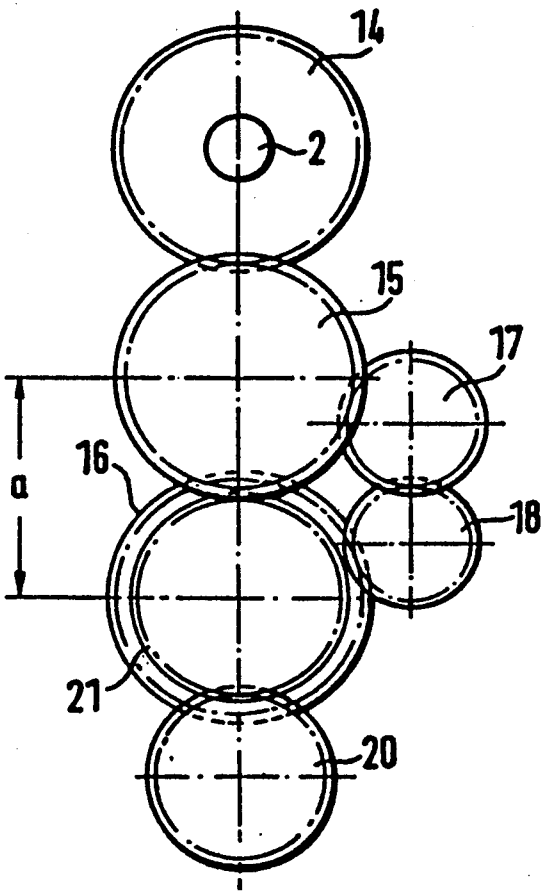
FIG. 2 is an end view of the drive gearing arrangement for the printing system of FIG. 1.

A rubber blanket cylinder 1 is retained on a shaft 2, which is journalled in eccentric bearings 11, retained in side walls 3, 4, or a frame of the printing machine. A plate cylinder 5 is engaged against the rubber blanket cylinder, to cooperate therewith, the plate cylinder 5 being secured on a shaft 6 which is suitably journalled in the side walls 3, 4. The plate cylinder 5 receives ink from an ink application cylinder 7 which is coupled to a shaft 8, retained in eccentric bearings 12 in the side walls 3, 4. An anilox roller 10 is secured in the side walls by a shaft 9, to supply ink to the ink application cylinder 7, see FIG. 1.

Preferably, the eccentric bearings 11, 12 are constructed as double eccentrics of any suitable arrangement, as well known in the printing machinery field. The anilox roller 10 is retained in bearings 13 which can be eccentric bearings.

A drive gear 14 is secured to the shaft 2 of the blanket cylinder 1. A drive gear 15 is secured to the shaft 6 of the plate cylinder 5. Gears 14, 15 are in meshing engagement, and the pitch circle diameter of gear 14 is the same as that of gear 15. The drive gear 14 is driven from the main drive train of the machine by a pair of bevel gears 22, 23, coupled to a drive shaft 24 which forms part of the machine drive train, and driven by a suitable motor for the entire printing system.

Figure 1:
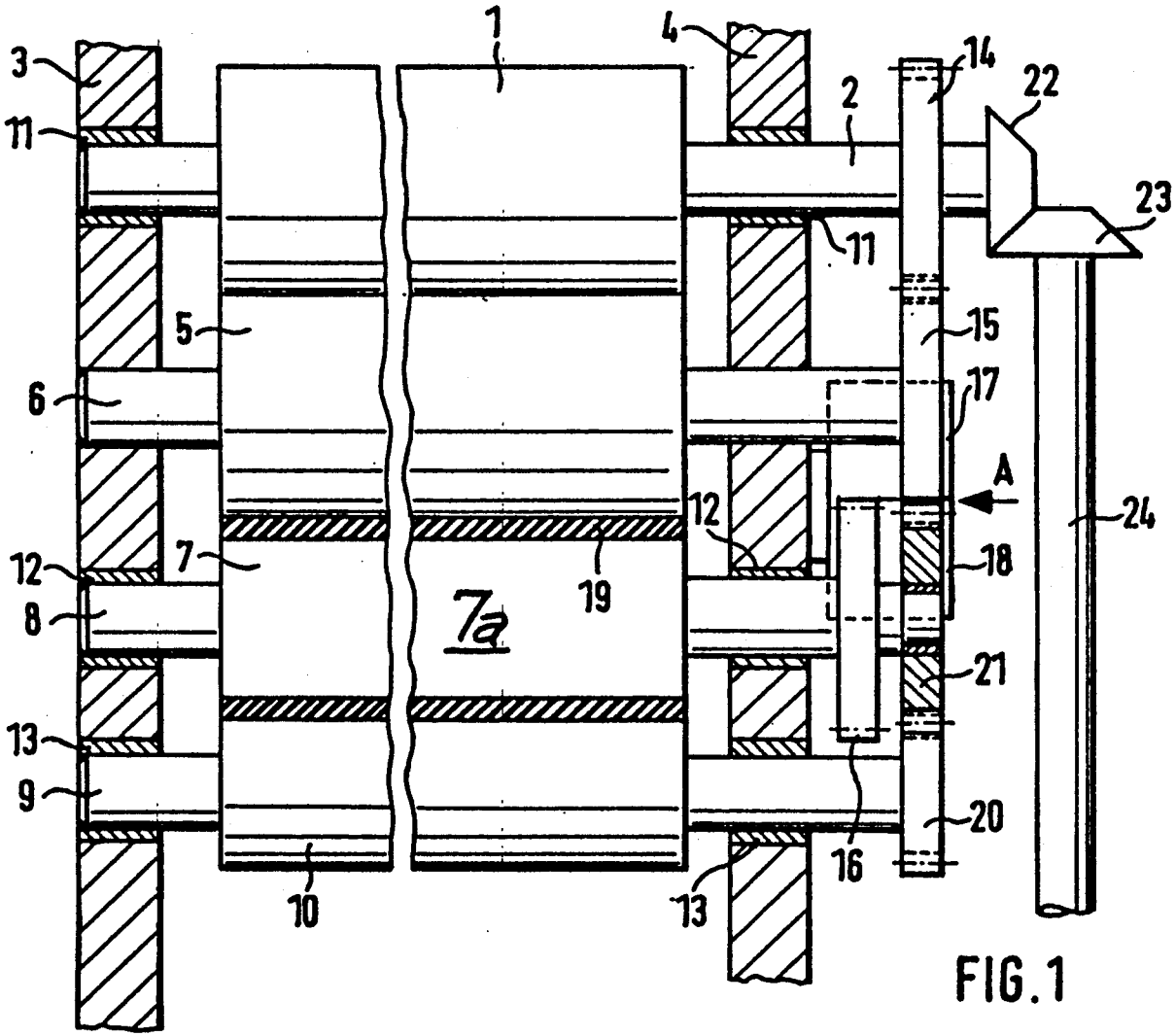
FIG. 1 is a highly schematic side view of an offset printing machine system, with some elements are shown in section, for better illustration.

In the embodiment shown in FIG. 1, the blanket cylinder 1 is covered with a compressible rubber blanket. The diameter of this cylinder, therefore, is so dimensioned that, after application of the blanket, that is, when the system is in operative state, it is just slightly less than the pitch circle of the gear 14. At the same time, the diameter of the plate cylinder 5 with the plate applied thereon is just slightly greater than the pitch circle of the gear 15. The differences in diameters of the two cylinders 1, 5, usually, are in an order of magnitude which permits direct engagement of the gears 14, 15 with the gear profiles being slightly shifted.

The shaft 8 of the ink application cylinder 7 has a gear 16 secured thereto which is laterally offset with respect to the gear 15 of the plate cylinder, so that the gears 15, 16 do not mesh. The gear 16 has the same pitch circle as the gears 14, 15. Two auxiliary gears 17, 18 are located laterally next to the gears 15 and 16—see FIG. 2. The first auxiliary gear 17 is in meshing engagement with the drive gear 15. Its gear teeth are wider than the teeth of the drive gear 15. The first auxiliary gear 17 meshes with a second auxiliary gear 18, the gear teeth of which engage adjacent the gear 15 with the first auxiliary gear 17. The auxiliary gear 18 is in meshing engagement with the drive gear 16 of the ink application cylinder 7, as seen in FIG. 1, and schematically shown by the full-line and chain-dotted line circles in FIG. 2.

To drive the anilox roller 10 from the drive chain formed by elements 24, 23, 22, 14, 15, a gear 21 is loosely seated or journalled on the shaft 8 of the ink application cylinder 7 which is in engagement with the gear 15 and has a smaller pitch circle diameter than that of the gear 16. The gear 21 is in meshing engagement with the gear 20 which is coupled to the shaft 9 of the anilox roller 10. The gear 20 can be used as a drive gear for further elements, units or systems of the printing machine, for example for an ink pump or the like.

The ink application cylinder 7 has a core 7*a* and a yielding surface 19 thereon, for example a rubber layer made of yielding material shown exaggerated in FIG. 1. The ink application cylinder 7 is constructed of a rigid core material 7*a*, on which the layer 19 is applied.

OPERATION, EMBODIMENT OF FIGS. 1 AND 2

In various applications, the yielding surface 19, typically a rubber layer of yielding material, is of such characteristic or thickness that, in operation, the radius of the ink application cylinder at the engagement region will be less than the radius of the plate cylinder 5. Still, the circumferential speed of the two cylinders at the engagement zone will be the same. The spacing a of the centers of the shafts 6, 8 between the plate cylinder 5 and the ink application cylinder 7, when the eccenters are all in operating or printing position, can be so reduced that engagement of meshing gears on the shafts 6 and 8 is no longer possible, if the gears are to have the same pitch circle diameter or, effectively, the same size. When the spacing a deviates from the diameter of the plate cylinder or, in other words, from the diameter of the pitch circle of the gear 15 by a marked degree, merely changing the profile of the meshing gear, for example gear 21 if it is fixed on shaft 8, is no longer possible. Yet, by driving the shaft 8 through the auxiliary gears 17, 18, and laterally offsetting gear 16, fixed to the shaft 8, any required or desired axial spacing a can be arranged, with the circumferential speeds of both cylinders 5 and 7 being the same.

The layer or surface 19 can be secured to the core 7*a*, or can be applied on the core 7*a* to be replaceable.

In operation, compression of the yielding layer 19 can be in the order of several tenths of a millimeter.

The drive of the ink application roller 7, as described in connection with FIGS. 1 and 2, effectively avoids slippage or rubbing between cylinders 5 and 7. Thus, the quantity of the damping liquid or damping fluid emulgated within the ink at the contact zone or contact region between the plate cylinder and the ink application cylinder is minimized. It is thus possible to vary the quantity of damping fluid applied to the plate cylinder per unit time within a wider range than previously possible, without causing water or damping fluid marks or striping, ghosting, or scumming or tinting. Eliminating precise adjustment of damping fluid substantially facilitates and speeds up the adjustments of a printing machine system.

EMBODIMENT OF FIG. 3

Figure 3:
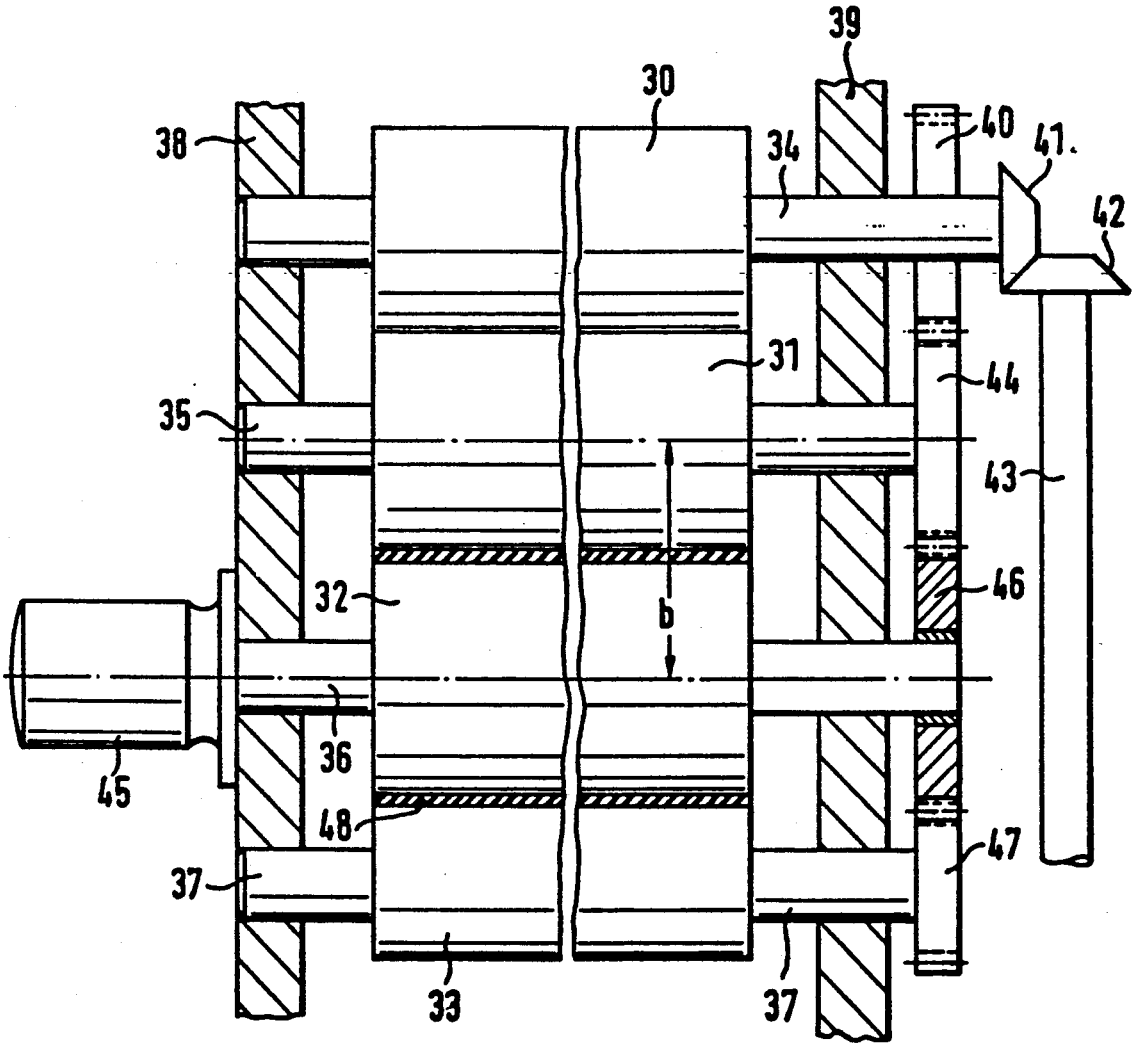
FIG. 3 is a side view corresponding to FIG. 1, but illustrating another embodiment.

Operation of the ink application cylinder at the same speed as that of the plate cylinder can also be obtained by an independent drive for the ink application cylinder. FIG. 3 illustrates, highly schematically, a printing system having a blanket cylinder 30, a plate cylinder 31, an ink application cylinder 32 and an anilox roller 33, the respective shafts 34, 35, 36, 37 of which are retained between side walls 38, 39, similar to the embodiment described in connection with FIG. 1. A gear 40 is secured to shaft 34, and driven via bevel gears 41, 42 by a shaft 43 from a main drive train of the printing machine.

A gear 44 is in meshing engagement with the gear 40, the gear 44 being secured to the shaft 35 of the plate cylinder. Both gears have the same pitch circle diameter. Cylinders 30, 31, as described in the embodiment of FIG. 1, have slightly different diameters. The ink application cylinder 32 has a covering or surface of compressible material. This material may, for example, be formed by a plurality of rubber layers, one of which has air bubbles occluded therein. The diameter of the ink application cylinder 32, ready for operation but not yet engaged, is larger than that of the plate cylinder 31. To avoid rubbing or slippage between the cylinders 31 and the rubber covered cylinder 32 at the engagement surface, an electric drive motor 45 is coupled to the cylinder 32. Drive motor 35 is a controlled speed motor, so that the speed of the cylinder 32 can be matched to be the same as the circumferential speed of the cylinders 30, 31. The shaft 36, further, retains a gear 46 thereon, seated loosely on the shaft 36, which gear 46 meshes with the drive gear 44 and with a gear 47 coupled to the shaft 37 of the anilox roller 33. The gear 46 has a larger pitch circle diameter than that of the drive gear 44, in order to cover the distance b. This distance is so long that direct engagement between gears seated on shafts 35 and 36, respectively, and having the same pitch circle diameter, is no longer possible. Gear 46 merely transfers rotary power from gear 40 via gear 44 to gear 47, to drive the anilox roller 33 and, if desired, any other auxiliary devices or apparatus.

Various changes may be made, and features described in connection with any one of the embodiments may be used with any of the others, within the scope of the inventive concept.

We claim:

1. Offset printing machine system having a rubber blanket cylinder (1, 30), having a blanket cylinder shaft (2, 34);

a plate cylinder (5, 31) having a plate cylinder shaft (6, 35);

an ink application cylinder (7, 32) having an ink cylinder shaft (8, 36);

a yielding surface covering (19, 48) on said ink application cylinder;

means (14, 15; 40, 44) for driving said blanket cylinder shaft and said plate cylinder shaft at the same speed, including plate cylinder gear means (15, 44) secured to the plate cylinder shaft (6, 35), said cylinders being engaged against each other and rolling off against each other, and defining engagement regions at the respective nips between said cylinders, wherein, in accordance with the invention, the diameter of the ink application cylinder (7, 32) differs from the diameter of the plate cylinder (5, 31) when said cylinders are engaged against each other; and wherein said drive means includes means for driving the ink application cylinder (7, 32) at a circumferential speed corresponding to the speed of the plate cylinder (5, 31) to cause the engagement region of the ink application cylinder and of the plate cylinder to move at the same speed, and wherein said ink application cylinder driving means compensate for differences in effective diameter at said engagement region between the ink application cylinder and the plate cylinder, while maintaining said corresponding circumferential speeds of the ink application cylinder (7, 32) and the plate cylinder (5, 31).

2. The system of claim 1, wherein said driving means for the ink application cylinder (7, 32) comprises driving gear means out of direct engagement with the plate cylinder gear means (15, 44) on the cylinder shaft (2, 34).

3. The system of claim 2, wherein (FIGS. 1 and 2) said driving means comprises an ink cylinder gear (16) secured to said ink cylinder shaft (8), and two auxiliary meshing gears (17, 18) are provided, one each, meshing, respectively, with the ink cylinder gear (16) and with the plate cylinder gear means (15).

4. The system of claim 3, wherein said ink cylinder gear (16) and said plate cylinder gear means (15) are laterally offset with respect to each other to permit in-line positioning of the shafts of the cylinders and drive of the ink application cylinder via said auxiliary gears.

5. The system of claim 1, further including an idler gear (21, 46) loosely rotatable and secured on said ink cylinder shaft (8, 36), said idler gear meshing with the plate cylinder gear (15, 44);

and a roller means (10, 33) having a roller shaft (37) and a roller gear (20, 47) thereon, in meshing engagement with said idler gear (21, 46).

6. The system of claim 1, wherein said yielding surface includes a surface covering layer (19, 48) capable of changing its volume; and wherein the diameter of the ink application cylinder (32), when in operation, is larger than the outer diameter of the plate cylinder (31) when in operation.

7. The system of claim 1, wherein the spacing (a) of the centers of the plate cylinder shaft (6) and of the ink cylinder shaft (8) is less than the operative diameter of the plate cylinder (5).

8. The system of claim 1, further including an anilox roller (10, 33) in ink transferring engagement with the yielding surface covering (19, 48) of said ink application cylinder.

9. The system of claim 1, wherein said driving means comprises a speed controllable motor (45) coupled to one of: said ink application cylinder (32); said plate cylinder (31); and a drive chain (43, 42, 41, 40, 44) driving at least one cylinder (31) which is not coupled to the electric motor (45).

10. The system of claim 9, wherein the speed controllable motor comprises an electric motor (45) coupled to the ink application cylinder (32).

11. The system of claim 1, further including a machine frame (3, 4), said cylinder shafts being rotatably journalled in said machine frame; and wherein the spacing (a, b) of the center of the plate cylinder shaft (6, 35) from the center of the ink cylinder shaft (8, 36) differs from the spacing between the pitch circle diameter of the plate cylinder gear means (15, 44) and a theoretical gear means meshing with the plate cylinder gear means and rotating about the ink application cylinder shaft (8, 36).

12. The system of claim 11, including an ink cylinder gear (16) secured to said ink cylinder shaft (8), and two auxiliary meshing gears (17, 18) are provided, one each, meshing, respectively, with the ink cylinder gear (16) and with the plate cylinder gear means (15).

13. The system of claim 12, wherein said ink cylinder gear (16) and said plate cylinder gear means (15) are laterally offset with respect to each other to permit in-line positioning of the shafts of the cylinders and drive of the ink application cylinder via said auxiliary shafts.

* * * * *